US005957817A

United States Patent [19]

Koenig et al.

[11] Patent Number: 5,957,817

[45] Date of Patent: Sep. 28, 1999

[54] ROWING EXERCISE APPARATUS FOR USE WHILE STANDING

[75] Inventors: Larry Koenig, Williamsburg; Lyle Hyke, Lisbon, both of Iowa

[73] Assignee: Jam'n Fitness Corp., Williamsburg, Iowa

[21] Appl. No.: 09/136,562

[22] Filed: Aug. 19, 1998

[51] Int. Cl.[6] ..... H63B 21/06

[52] U.S. Cl. ..... 482/72; 482/137; 482/97; 482/98

[58] Field of Search ..... 482/97, 137, 98, 482/133, 72, 95, 96

[56] References Cited

U.S. PATENT DOCUMENTS

| | | | |
|---|---|---|---|
| 4,336,934 | 6/1982 | Hanagan et al. | 482/97 |
| 4,923,195 | 5/1990 | Calderone | 482/97 |
| 5,135,449 | 8/1992 | Jones | 482/72 |
| 5,304,107 | 4/1994 | Jones | 482/97 |
| 5,358,462 | 10/1994 | Calderone | 482/97 |
| 5,529,558 | 6/1996 | Koenig | 482/97 |
| 5,749,813 | 5/1998 | Domzalski | 482/97 |

*Primary Examiner*—Jerome W. Donnelly
*Attorney, Agent, or Firm*—Allan L. Harms

[57] ABSTRACT

An improved exercise apparatus for muscles of the upper extremities, mid-back, and posterior shoulder girdle provides negative variable resistance as the muscles are contracted over a wide range of motion while maintaining proper joint alignment in the shoulders, elbows, and wrists. A movable weight carrying assembly has a transverse handlebar from the ends of which extend handle members which the user grasps to pivot the weight carrying assembly toward himself or herself while moving the arms from an outstretched position to a position with the elbows flexed, scapulae adducted, and the trapezius muscles contracted in a shrugging action. The weight carrying assembly is adjustable for varying heights of user.

19 Claims, 3 Drawing Sheets

ROWING EXERCISE APPARATUS FOR USE WHILE STANDING

BACKGROUND OF THE INVENTION

In the field of body exercise and strength training, there is a need to exercise the posterior deltoid rotator cuff, rhomboideus, latissimus dorsi, and trapezius muscles under a resistive load. Various exercisers have been devised to strengthen these muscles of the body through pulling movements, including pulling weight-bearing cables over pulleys or using a complicated lever apparatus with each arm bearing a separate load. However, the use of available exercise machinery does not vary the resistance presented to the muscles as the body's ability to overcome resistance increases. The known devices fail to vary the load between stages in the exercise when the body is weaker such as when the elbows are fully flexed and they fail to promote proper joint alignment as the exercise is performed. A need exists for an exercise machine which can be safely used to effectively resist the action of the back muscles and which provides variable loading and proper joint alignment as the device is used.

SUMMARY OF THE INVENTION

The present invention relates to apparatus useful to an athlete to increase upper body strength, and in particular for strengthening latissimus dorsi and trapezius muscles and the rotator cuff. The invention allows the user to perform strengthening exercises while maintaining proper shoulder, elbow, and wrist joint alignment throughout the movements made with reduction in effective load as the muscles reach relatively weaker positions. A supporting base is provided with a foot plate on which the user stands. A cushion on an adjustable height stand is positioned on the base. The cushion member is adjustable in height above the base and is positioned beside the foot plate on which the user stands. The foot plate on which the user stands is tilted downward toward the cushion stand and the user leans against the cushion to restrain the user from pulling himself or herself forward as the exercise apparatus is used.

A weight rest member stands above the second end of the frame opposite the foot plate and serves as a rest for a weight carrying member. The weight carrying member is pivotally mounted to a horizontal bar fixed between the cushion stand and the weight rest member. The weight carrying member is pivotable toward the user in a vertical plane which is aligned with the centerline of the user. The weight carrying member includes a bar which extends upward and away from the user when the weight carrying member rests on the weight rest member. A transverse handlebar is mounted at or near the upper end of the upwardly extending bar and has a handle member mounted at each of its ends by a multiple axis pivotable joint. The handle members are curved to allow each handle grip to be easily grasped by the user with his or her arms outstretched in a natural position for the wrists. Each handle member is freely rotatable as the user pulls the pivotable member towards himself or herself. In addition, each multiple axis pivotable joint allows the handle to be pivotable over a lateral range about its end of the handlebar. Further, each handle member is rotatable about and over the axis of the transverse arm through an approximate sixty-degree range. By allowing the handle members to be freely moveable about several axes, the apparatus prevents the user from having to constrain the wrists, elbows, or hands as the pivotable member is drawn toward the user. The wide range of motion of the handle members on the ends of the handlebar allows the user to bring his or her elbows backward past his or her sides and to shrug, thereby increasing the flexion of the trapezius muscles.

A weight displacement arm depends from the bar of the weight carrying member in the plane of movement of the bar. A weight support rod is transversely mounted at the free end of the weight displacement arm and is sized so that Olympic barbell weights can be mounted on the weight support rod in such weights and numbers as are chosen by the user.

In order to allow the apparatus to be used by differing sizes of persons, the handlebar is adjustable relative to the point of pivot of the pivotable member so that the height of the handle members may be set at a comfortable height for the user, especially to allow the forearms and wrists of the user to remain generally horizontal as the pivotable member is drawn close to the user and the elbows move past the user's sides. The height adjustment is provided by mounting the handlebar to a telescoping bar which is received by a hollow box tube, the telescoping bar and the box tube being part of the upwardly extending bar of the weight carrying member. The selected height adjustment is maintained by use of a telescoping bar maintained in selected extension by a pop pin assembly.

It is an object of the invention to provide an exercise apparatus which decreases the resistance to the muscles of the user as the muscles decrease in effective strength.

It is a further object of the invention to provide an exercise apparatus for strengthening trapezius and latissimus dorsi muscles of a user.

It is a further object of the invention to provide an exercise apparatus which allows the shoulders of the user to travel over a full range of motion.

It is a further object of the invention to provide an exercise apparatus which may be conveniently loaded with existing Olympic sized or other barbell weights.

It is a further object of the invention to provide an exercise apparatus which allows the user to strengthen latissimus dorsi and trapezius muscles at minimal risk of injury to the ligaments, tendons and joints of the user.

It is a further object of the invention to provide an exercise apparatus which may be adjusted for varying strength and size of users.

These and other objects of the invention will become apparent from examination of the description and claims which follow.

DESCRIPTION OF THE DRAWING FIGURES

DETAILED DESCRIPTION OF THE INVENTION

Figure 1:
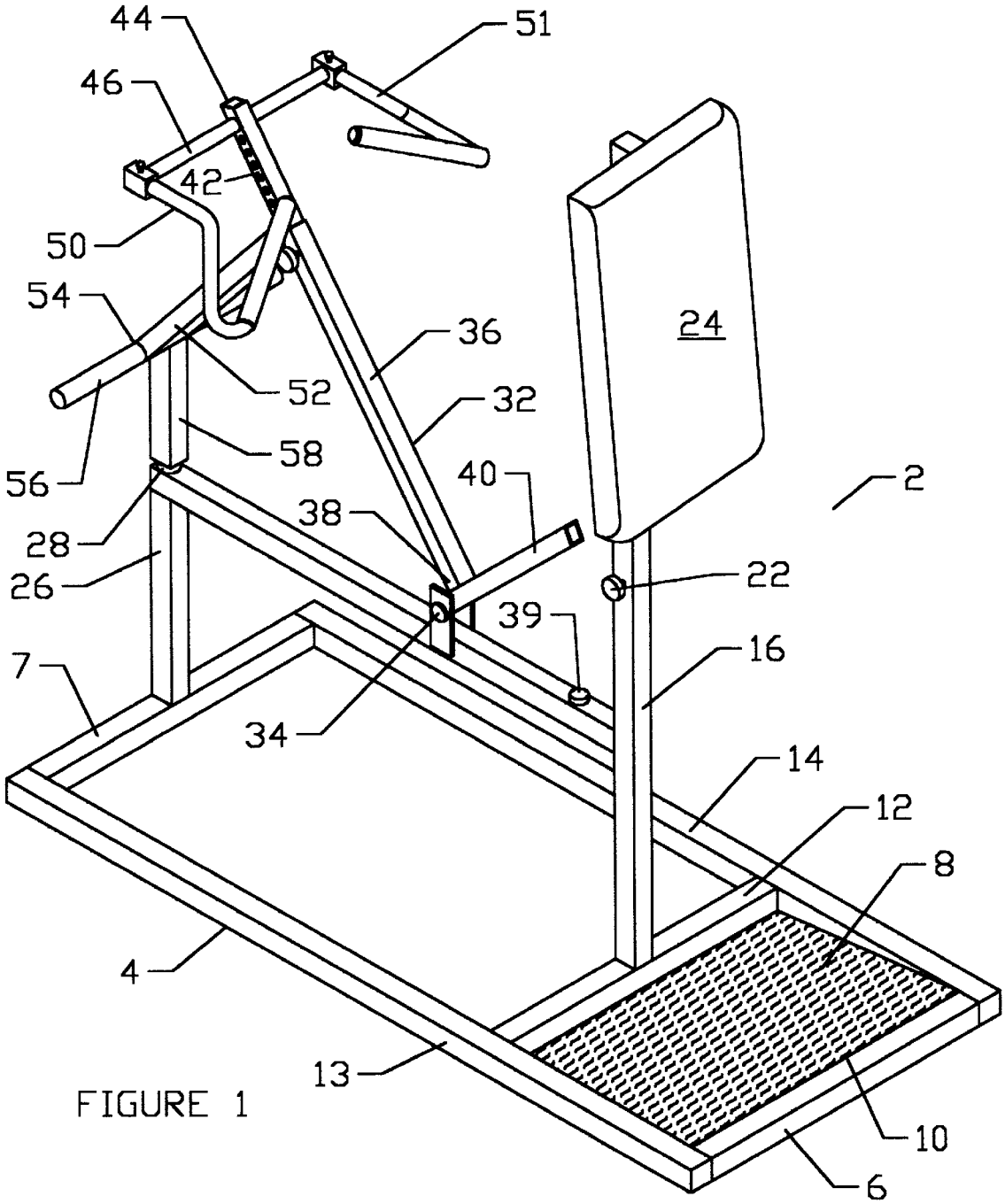
FIG. 1 is a front left perspective view of the rowing exercise apparatus invention shown at rest.
Figure 2:
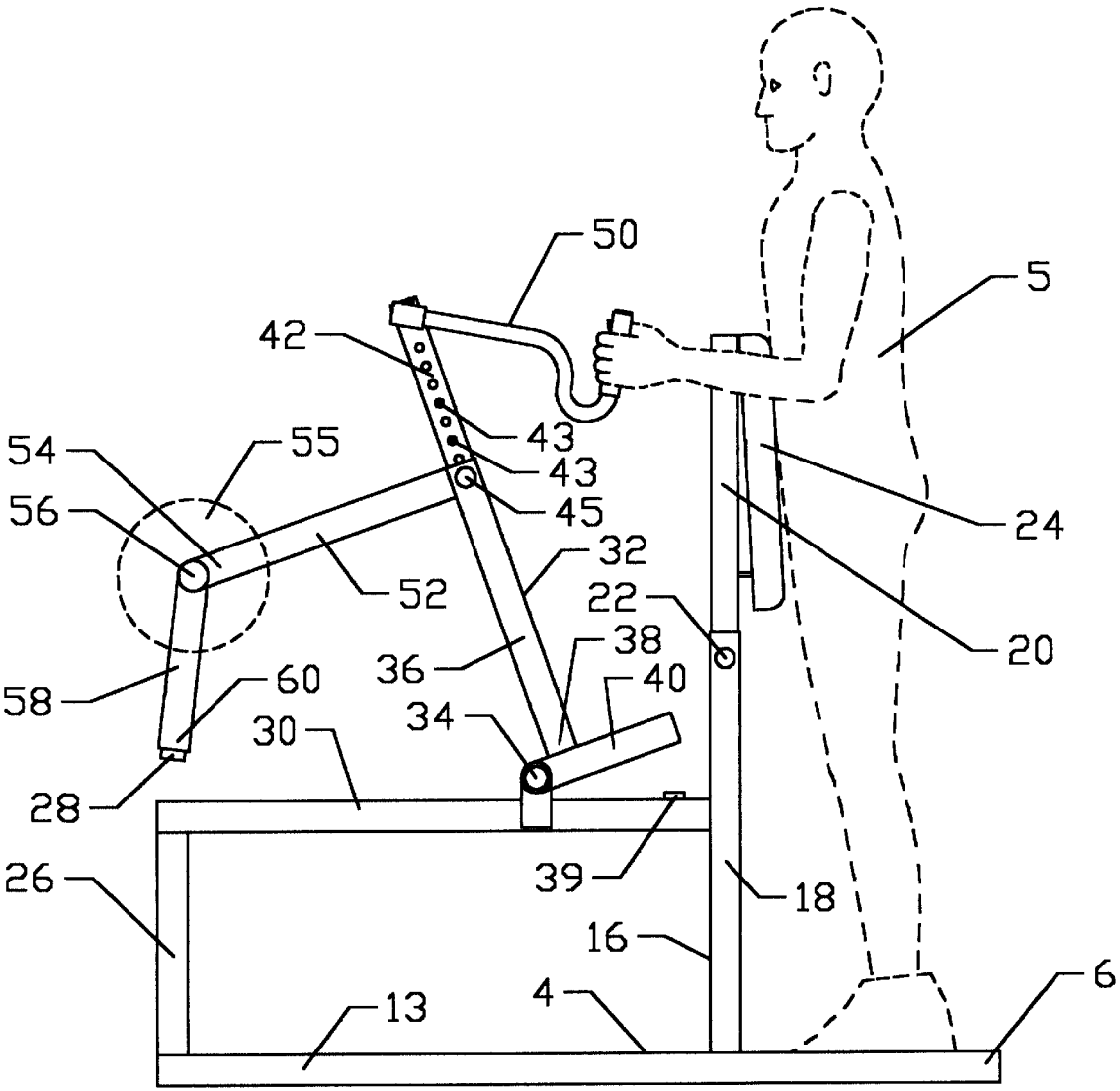
FIG. 2 is a front elevation of the invention being operated by a user. The user and barbell weights mounted to the invention are shown in phantom.

Referring to FIGS. 1 and 2, the exercise apparatus for arm and back muscles is illustrated. The invention 2 includes a base 4 which is generally rectangular. At a first end 6 of base 4 is disposed a foot plate 8 extending from side 13 to side 14 of base 4. Foot plate 8 is preferably tilted downward from its higher edge 10 which is adjacent first end 6. User 5, shown in phantom, is stationed standing on foot plate 8. Foot plate 8 extends to cross member 12 mounted between sides 13, 14 of base 4. Cushion stand 16 stands above cross member 12. Cushion stand 16 includes a lower elongate box tube 18 into which is telescopingly slidable an upper cushion mounting shaft 20 which is held in a selected vertical position by means of adjustment knob 22 which may be manipulated by the user to loosen cushion mounting shaft 20 within box tube 18 to allow cushion 24 to be selectively vertically adjusted to comfortably engage the abdomen of user 5. Other means to restrain forward motion of user 5 may be employed as an alternative to cushion 24.

Forward of cushion stand 16 at the second end of base 4 is an upstanding post 26. A horizontal bar 30 is disposed between cushion stand 16 and upstanding post 26 which serves as a support for movable member 32. In the preferred embodiment, movable member 32 is pivotable upon horizontal bar 30 such that movable member 32 pivots in the plane defined by cushion stand 16 and upstanding post 26. It is to be understood that the precise structure illustrated in the drawings is but one arrangement whereby the pivot pin 34 of movable member 32 is maintained at a height slightly below the height of the user's patella, or in the range of 12–24 inches above the base 4, preferably about eighteen inches above the frame 4 when an adult of average height is the intended user of the device. Pivot pin 34 is preferably disposed a small distance horizontally removed and forward of the user.

Movable member 32 comprises a first telescoping elongate bar 36 having a lower end 38 to which is mounted a generally perpendicular lever 40. Lever 40 is pivotable about pivot pin 34 such that movable member 32 pivots about pivot point 34. A resilient stop 39 is disposed on horizontal bar 30 to engage lever 40 and limit travel of moveable member 32 as it is pulled by user 5 toward himself or herself. First telescoping bar 36 includes inner shaft 42 which is selectively slidable within the outer housing 48 of telescoping bar 36. At or near upper end 44 of inner shaft 42 is transversely mounted a handlebar 46 having opposing ends to which are mounted a pair of handle members 50, 51. Handle members 50, 51 are spaced apart a typical spacing of an average adult person's shoulders.

Midway along elongate bar 32 is fixed a weight displacement arm 52 which depends at an angle, preferably perpendicularly, from elongate bar 32 on the side thereof directed away from cushion stand 16. Weight displacement arm 52 is preferably disposed in the plane of travel of moveable member 32. Disposed at or near the free end 54 of weight displacement arm 52 is a horizontally oriented weight support bar 56 on which typical barbell weights 55 may be placed. In the preferred embodiment, weight support bar 56 is a two-inch diameter rod to accommodate Olympic weights and is centered on free end 54 of weight displacement arm 52. Depending from free end 54 of weight displacement arm 52 is stub arm 58 which is angularly disposed upon free arm 52 such that it will abut horizontal bar 30 at or near its mounting to upstanding post 26. A resilient bumper 28 is fixed at free 60 of stub arm 58 to cushion abutment of stub arm 58 on horizontal bar 30. The length and angular disposition of stub arm 58 are designed to allow moveable member 32 to come to rest with stub arm 58 abutted to the top of horizontal bar 30. When so at rest, weights 55 may be safely added or removed from weight support bar 56 and the length of moveable member 32 may be adjusted to fit the user's needs.

Figure 3:
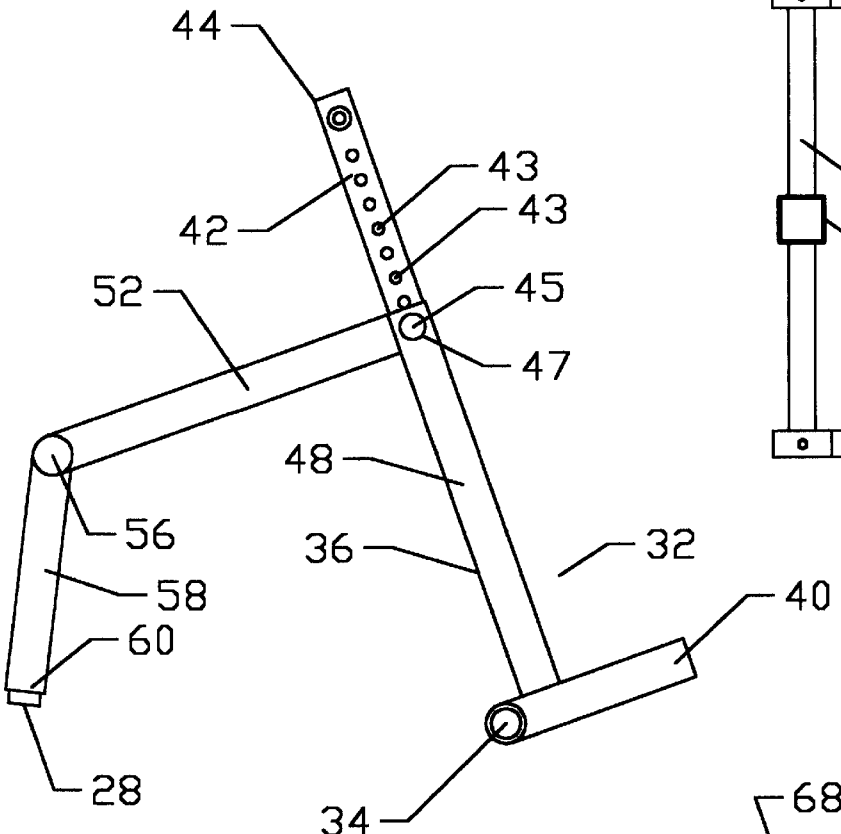
FIG. 3 is a front expanded view of the movable member of the exercise apparatus shown with the handles thereof omitted.

Referring now to FIG. 3, moveable member 32 is illustrated with handlebar 46 and handles 50, 51 omitted. Inner shaft 42 of movable member 32 is slidable within the housing 48 of telescoping bar 36. The length of telescoping bar 36 is adjustable by extension or retraction of inner shaft 42 within housing 48 of telescoping bar 36. Holes 43 along inner shaft 42 are provided to receive plunger pin 45 which is topped by knob 47 such that the user may easily adjust the height at rest of the handlebar 46 to be comfortable for use. Knob 47 is drawn away from housing 48 such that plunger pin 45 will be drawn from one of holes 43 of inner shaft 42 and inner shaft 42 may be slid from or into housing 48 to the desired extension and plunger pin 45 allowed to drop into one of holes 43.

Figure 4:
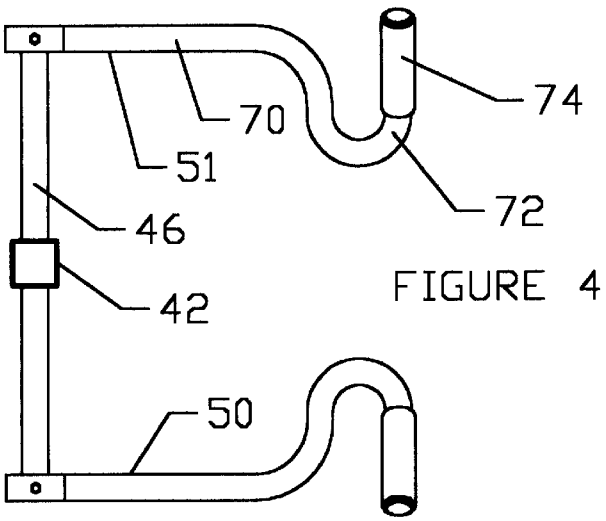
FIG. 4 is a top plan view of the handle bar and handles of the invention.
Figure 5:
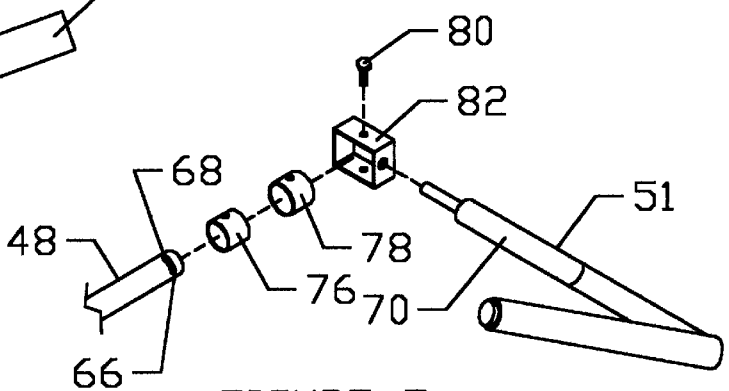
FIG. 5 is an exploded perspective view of the handle bar and one handle member and the multiple axis hinge interconnecting them.

Referring now to FIGS. 4 and 5, the details of handle bar 46 and handle members 50, 51 may be observed. A handle member 50, 51 is mounted to each of the opposing ends of handlebar 46. Each of handle members 50, 51 includes a shaft 70 fixed at one end to handle bar 46 and terminating on the opposing end in a curved handle 72 covered with a cushioned grip 74. The length of shaft 70 is selected such that the user may extend his or her hands forward to grasp the handles while resting against cushion 24. Each handle member 50, 51 is freely rotatable about the axis of shaft 70 and also each handle member 50, 51 may pivot laterally over a limited range (±30 degrees from perpendicular) upon the end of handlebar 46. Further, each handle member 50, 51 may independently rotate about the axis of handlebar 46 in a range of approximately 60 degrees with the lower extreme of the rotation being a position in which shafts 70 are generally horizontal when weight displacement arm 52 rests atop upstanding support 26.

Referring now to FIG. 5, the structure utilized to allow the unique movements of handle members 50, 51 upon handlebar 46 is illustrated in an exploded view. Handlebar 46 is preferably a hollow tube having equivalent structures on each end. End 66 of handlebar 46 is provided with paired annular slots 68, 69 of which upper slot 68 extends from the top of handlebar 46 away from first end 6 about 60 degrees when moveable member 32 rests on bumper 28, while lower slot 69 diametrically opposes upper slot 68. A nylon cylindrical insert 76 is received within bushing 78 and the bushing 78 with nylon insert 76 overlies end 66 of handlebar 46. An end cap 82 overlies the bushing 78 and a capscrew 80 is passed through an opening in end cap 82 which is in registration with an opening through bushing 78, insert 76, and with slots 68, 69. Handle shaft 70 is fixed to end cap 82 such that shaft 70 may rotate about its own axis.

Operation of the Invention

A user choosing to exercise his or her arm and back muscles may adjust the height of cushion 24 to a comfortable engagement with the user's abdomen and may also adjust the height of handle bar 46 by extending or retracting inner shaft 42 within telescoping elongate bar 36 and securing it in place by operation of plunger pin 45. The user then may place selected weights on the weight support bar 56 of moveable member 32. Then while standing on foot plate 8 and leaning the abdomen against cushion 24, the user may grasp each of handle members 50, 51 in the hands and turn them to a comfortable position and begin to draw the moveable member 32 toward himself or herself. As this is done, barbell weights 55 describe a curved path as the user brings the hands closer to the user's sides, with the weights 55 drawn closer to the fulcrum provided by the pivot pin 34, thereby reducing the moment arm of the barbell weights 55 and reducing the resistive force provided by the weights 55 as the user draws the hands further back and shrugs the shoulders, thereby exercising the trapezius muscles while simultaneously working the latissimus dorsi muscles and encountering lessening resistance as the muscles reach positions of reduced leverage. The variability of the angular relationships of the handle members 50, 51 to handlebar 46 permits proper joint alignment throughout the movements made while using the invention.

Having described the invention, we claim:

1. Exercise apparatus for strengthening upper body muscles of a user comprising a base having a user station end and an opposing second end, said base including means to restrain forward motion of said user positioned at said user station end, a first support member mounted to said base and disposed thereabove, a weight-carrying assembly supported on said first member, the weight-carrying assembly comprising an elongate bar having a lower end and an upper end, said lower end pivotably mounted upon said first support member, said elongate bar extending upwardly and away from said user station end when said exercise apparatus is in a rest position, said weight-carrying assembly rotatable about its lower end toward said user station end of said base, a transverse handlebar mounted along said elongate bar at or near the upper end thereof, means for said user to grasp said handlebar with said user's hands to draw said handlebar toward said user, said elongate bar having a weight displacement arm depending therefrom along the length thereof, means to selectively suspend free weights from said weight displacement arm, said handlebar has opposing ends, each of said ends of said handlebar having a handle member depending therefrom, each of said handle members is disposed generally horizontally, each of said handle members is freely axially rotatable.

2. The exercise apparatus of claim 1 wherein said means for restraining forward motion of said user comprises a second support member adjacent said station end, said second support member supporting a cushion, said cushion disposed at a height which engages the abdomen of the user standing at said user station end, said means to selectively suspend free weights from said weight displacement arm comprises said weight displacement arm having a rod transversely mounted therealong, said transverse rod able to receive free weights thereon.

3. The exercise apparatus of claim 2 wherein a third support member upstands from said base, said transverse rod is supported upon said third support member when said exercise apparatus is at rest.

4. The exercise apparatus of claim 1 wherein each of said handle members is laterally pivotable about said ends of said handlebars.

5. The exercise apparatus of claim 1 wherein each of said handle members may be rotated about the axis of said handlebar in a range of approximately 60°.

6. The exercise apparatus of claim 1 wherein said elongate bar of said weight-carrying assembly comprising a lower housing and a telescoping upper shaft slidable in said lower housing, said shaft is selectively fixable at a multiplicity of extensions from said lower housing.

7. The exercise apparatus of claim 1 wherein said elongate bar is provided with a perpendicularly mounted lever extending from said lower end of said elongate bar, a stop member is disposed upon said first support member to engage said lever as said weight-carrying assembly is pivoted toward said user station end.

8. The exercise apparatus of claim 2 wherein said second support member is an upstanding post, said second support member is selectively adjustable in height, said first support member is a generally horizontal bar mounted between said second support member and said third support member, said first support member is disposed in the range of twelve to twenty-four inches above said base.

9. Exercise apparatus for use to strengthen upper body musculature of a user comprising a base frame having first and second ends, a foot plate mounted within said frame at the first end thereof on which the user may stand, a moveable assembly mounted to said frame between said first and second ends thereof, a cushion member disposed above said frame between said first end thereof and said movable assembly, said movable assembly including an elongate member having a lower end and an upper end, said moveable assembly pivotable about the lower end of the elongate member in a plane parallel to the axis of said frame, said elongate member having an arm transversely mounted thereto at generally the upper end thereof, said arm having opposing ends, a pair of handle members hingedly attached to said arm and spaced apart thereon, said elongate member having an elongate displacement arm depending therefrom, a cross member mounted to said displacement arm along the length thereof, said cross member spaced apart from said elongate member, said cross member capable of receiving weight elements thereon, means for limiting the pivotable travel of said moveable assembly, whereby said user may stand on said foot plate and lean against said cushion member and grasp said handles and pull said moveable assembly toward said user.

10. The exercise apparatus of claim 9 wherein each of said handle members has an elongate shank and a grip, said shanks of said handle members being disposed generally horizontally when said moveable assembly is at rest, said shanks being freely axially rotatable.

11. The exercise apparatus of claim 9 wherein said elongate member is selectively extensible.

12. The exercise apparatus of claim 9 wherein said cushion member is vertically adjustable.

13. The exercise apparatus of claim 9 wherein said cross member is a rod of circular cross section.

14. Exercise apparatus for use by a user to simulate rowing movements comprising a base having first and second ends, a cushion support disposed above said base and spaced apart from said first end of said base, said cushion support having a cushion member mounted thereto, a pivotable arm mounted to said base and disposed thereabove and between said cushion support and said second end of said base, said pivotable arm having an upper free end and a lower end, said pivotable arm pivotable about the lower end thereof in a vertical plane, a means for mounting a pair of spaced apart handles to said pivotable arm, said lower end of said pivotable arm supported above said frame, said pivotable arm having a lever depending therefrom along the length thereof, said lever depending toward said second end of said base, said lever having a free end, said lever having a substantially horizontal bar mounted therealong, said bar sized to receive weights therealong, means to support said pivotable arm in a rest position when said pivotable arm is inclined away from said cushion.

15. The exercise apparatus of claim 14 wherein said means for mounting a pair of handles to said pivotable arm comprises a transverse bar mounted to said pivotable arm at or near the upper end thereof.

16. The exercise apparatus of claim 15 wherein said transverse bar is centered upon said pivotable arm and has opposing ends thereon, each of said opposing ends having a handle member depending therefrom.

17. The exercise apparatus of claim 16 wherein each of said handle members is rotatable about the axis of said transverse bar, each of said handle member is disposed horizontally when said pivotable arm is in said rest position.

18. The exercise apparatus of claim 17 wherein each of said handle members has an elongate shank and a grip, said shanks being freely axially rotatable.

19. The exercise apparatus of claim 14 wherein said horizontal bar comprises a rod of circular cross section sized to receive circular weight plates thereon.

* * * * *